United States Patent [19]

Gerard et al.

[11] 4,451,500

[45] May 29, 1984

[54] PROCESS FOR OBTAINING A HOMOGENEOUS PLANAR MAGNETIZATION LAYER IN A FERRIMAGNETIC GARNET

[75] Inventors: Philippe Gerard, Saint Ismier; Hubert Jouve, Biviers; Michel Madore, Grenoble, all of France

[73] Assignee: Commissariat a l'Energie Atomique, Paris, France

[21] Appl. No.: 417,597

[22] Filed: Sep. 13, 1982

[30] Foreign Application Priority Data

Sep. 21, 1981 [FR] France ..... 81 17763

[51] Int. Cl.[3] ..... B05D 3/06

[52] U.S. Cl. ..... 427/38; 427/53.1; 427/128; 427/130

[58] Field of Search ..... 427/38, 53.1, 128, 130

[56] References Cited

PUBLICATIONS

Thin Solid Films, vol. 60, No. 1, Jun. 1979.

Applied Physics, vol. 21, No. 2, Feb. 1980.

IEEE Transactions of Magnetics, vol. MAG-16, No. 5, Sep. 1980.

IBM Technical Disclosure Bulletin, vol. 23, No. 9, Feb. 1981, J. C. DeLuca et al., p. 4345.

Physical Review Letters, vol. 43, No. 19, Nov. 1979, P. Hansen et al., pp. 1444-1447.

*Primary Examiner*—Bernard D. Pianalto

*Attorney, Agent, or Firm*—Oblon, Fisher, Spivak, McClelland & Maier

[57] ABSTRACT

The invention relates to a process making it possible to obtain at least one homogeneous planar magnetization layer in a material constituted by a ferrimagnetic garnet film epitaxied on an amagnetic substrate.

According to this process, at least one implantation of ions, with the exception of ions of gaseous elements and those of metallic elements occurring in the composition of the solvent is performed in the film at a high dose. The film and substrate are annealed in order to recrystallize in monocrystalline form that part of the film made amorphous by implantation.

Application to the production of magnetic bubble memories.

10 Claims, 6 Drawing Figures

PROCESS FOR OBTAINING A HOMOGENEOUS PLANAR MAGNETIZATION LAYER IN A FERRIMAGNETIC GARNET

BACKGROUND OF THE INVENTION

The present invention relates to a process for obtaining a homogeneous planar magnetization layer in a ferrimagnetic garnet. In particular, the process of the invention makes it possible to obtain in a material constituted by a ferrimagnetic garnet film epitaxied on a monocrystalline amagnetic substrate a homogeneous planar magnetization layer by ion implantation. The invention more particularly applied to the field of producing magnetic bubble memories.

It is pointed out that a ferrimagnetic garnet film is prepared by liquid phase epitaxy on the basis of a solvent constituted by boron oxide ($B_2O_3$) and lead oxide (PbO).

In this field of application, it is known that the use of an ion implantation makes it possible to produce, on the surface of the ferrimagnetic garnet film, a planar magnetization layer serving to increase the stability of the magnetic bubbles. This makes it possible to increase the polarization field of the ferrimagnetic material above which the bubbles disappear. This polarization field is commonly called the collapse field. In addition, ion implantation aims at eliminating the hard bubbles (bubbles with complex wall structures) and enabling the movement of information, by defining non-implanted propagation paths in said layer.

The existence of the planar magnetization layer makes it possible to stabilize beneath the layer of implanted material the magnetic domains thereof.

The ions used hitherto for implantation are ions of gaseous elements such as hydrogen, helium and neon ions. These ions are generally implanted at doses below those necessary for making the material amorphous.

It is known that an implantation of ions in a material, more particularly incorporating a ferrimagnetic garnet film, leads to the formation of defects of different types in the crystal lattice of the material. These defects introduce strong mechanical stresses into the material.

It should be noted that the existence of the planar magnetization layer is linked with the fact that the strain anisotropy coefficient $K_i$ of the implanted layer is higher than the uniaxial anisotropy coefficient $K_u$ of the non-implanted material.

Moreover, the depth profile of these defects is not homogeneous. Thus, the distribution of these defects and the impurities (implanted ions) is, in depth, a Gaussian distribution. This is linked with the fact that the implanted ions are retarded in the material by electron retardation, thus creating a mechanical stress area. They are then stopped by nuclear retardation, thus creating an area in which certain of the crystal bonds are broken, which instantaneously leads to a reduction of the magnetization.

These two effects (mechanical stresses and non-homogeneous defect profile) resulting from the implantation, lead to modifications of the magnetic properties of the ferrimagnetic garnet films, e.g. modifications in the saturation magnetization intensity of these films and in the magnetic anisotropy energy. The magnetization intensity and the anisotropy energy are not homogenous throughout the thickness of the implanted layer, i.e. their profile is not flat.

FIG. 1 shows a curve a corresponding to a profile of defects obtained during an implantation of hydrogen ions at a dose of approximately $10^{16}$ atoms/cm$^2$ in a ferrimagnetic garnet film and with an energy of 50 keV. It should be noted that the implantation of hydrogen ions at a dose close to $10^{16}$ atoms/cm$^2$ does not modify the crystal structure of the garnet film.

This profile is obtained by differential etching measurements. This curve gives the differential etching rate between implanted area $V_I$ and non-implanted area $V_{NI}$ as a function of the etching depth (A) expressed in um. It can be seen that the defect profile is not homogeneous, i.e. the curve does not have a square shape. Consequently, the planar magnetization layer obtained by implantation is not homogeneous from the magnetic standpoint.

In order to improve the defect profile, consideration has been given to the performance of several successive implantations at different energy levels. The profile obtained in this case corresponds to curve b of FIG. 1. The operating conditions for obtaining this defect profile are the same as hereinbefore, except for the use of different doses of small ions implanted at different energies, which has the effect of a better depth distribution of the defects. It can be seen that this profile is slightly more homogeneous than in the case of a single implantation.

Moreover, in order to make the defect profile more homogeneous in the implanted material layer, said material undergoes an annealing stage consisting of placing the material in a furnace in which there is a higher temperature. This annealing makes it possible to rearrange the crystal lattice of the material disturbed during implantation. Generally, the annealing temperatures used are between 300° and 400° C. However, although this annealing makes the defect profile slightly more homogeneous, it is not adequate for obtaining a homogeneous planar magnetization layer.

BRIEF SUMMARY OF THE INVENTION

The present invention relates to a process for obtaining a homogeneous planar magnetization layer in a ferrimagnetic garnet.

More specifically, the present invention relates to a process making it possible to obtain at least one homogeneous planar magnetization layer in a ferrimagnetic garnet film obtained by liquid phase epitaxy in a solvent on a monocrystalline amagnetic substrate, wherein in said film at least one implantation of ions takes place, with the exception of the ions of the metallic elements involved in the composition of the solvent, this taking place at a dose making it possible to render the implanted part of the garnet film amorphous, and wherein the film and the substrate are annealed in order to crystallize in monocrystalline form that part of the film rendered amorphous by implantation.

The use of an implantation of ions at a dose above that necessary for making the garnet film amorphous, followed by annealing, makes it possible to obtain a homogeneous planar magnetization layer in the epitaxied layer.

Eariler research has revealed that implantations of ions of gaseous elements at doses above those necessary for making the film amorphous lead, during annealing, to surface blistering caused by the formation of aggregates of gaseous bubbles. The material which is then obtained has a polycrystalline and not a monocrystalline structure.

Moreover, it is known by experience that the metallic elements used in the composition of the solvent necessary for the liquid phase epitaxy, such as lead and boron, are harmful to the good magnetic properties of the garnet film.

According to a preferred embodiment of the process according to the invention, a multiimplantation of ions takes place in said film by carrying out a first implantation of a particular types of ions, followed by at least one second implantation of other type of ions, in order to obtain different properties at the same depth.

The use of multiimplantation according to the invention, followed by annealings, makes it possible to modify the properties of the implanted layer. Thus, the ions implanted according to the invention have an adequate concentration to significantly change the characteristics of the implanted layer, whose crystalline structure has been reconstituted by means of the annealing process. In this way, it is possible to implant ions, which modify the physical properties of the said layer, such as its optical, magnetic and electrical properties.

According to another preferred embodiment of the process according to the invention, a multiimplantation of ions of different types is performed in the said film, each type of ions being implanted at a different depth in order to obtain different properties at different depths.

According to another preferred embodiment of the process according to the invention, a double homogeneous planar magnetization layer is formed by carrying out a first ion implantation in the upper part of the film and a second ion implantation in the lower part of the film and this is carried out with ions which are lighter than the first ions, in order to obtain a better magnetic stabilization.

The use of multiimplantation in particular makes it possible to improve, compared with a monoimplantation, the magnetic homogeneity of the implanted layer.

According to another preferred embodiment of the process according to the invention, the implanted ions are ions of an element chosen from among iron, arsenic and gallium.

According to another preferred embodiment of the process of the invention, annealing is e.g. performed in an oxygen atmosphere in a furnace in which there is a temperature between 400° and 1000° C. and preferably between 600° and 700° C. Obviously, other atmospheres can be used, which will modify the annealing conditions.

These annealing temperatures make it possible to overcome technological problems and particularly deposition, whilst being advantageous in connection with ion implantation.

According to another preferred embodiment of the process according to the invention, annealing is performed by means of a laser beam.

As a result of the process according to the invention, consideration is given to the implantation of ions in very thin ferrimagnetic garnet films (thickness approximately 0.5 $\mu$m), implantation being carried out over a depth equal to one third of the thickness of the film. Moreover, it is known that the uniaxial anisotropy $K_u$ of the non-implanted material increases in the case of a decrease of the thickness of the epitaxied layer, i.e. the garnet film. This implies that the strain anisotropy coefficient $K_i$ of the implanted layer must preponderate in the latterin order to create the planar magnetization layer. The invention as defined hereinbefore makes it possible to obtain an amorphous implanted layer without uniaxial anisotropy, which again makes it crystalline by annealing, said layer being characterized by a homogeneous strain coefficient $K_i$.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

According to the invention, the production of a homogeneous planar magnetization layer on the surface of a ferrimagnetic garnet film epitaxied in conventional manner on a monocrystalline amagnetic substrate, is linked with the implantation of ions in the garnet film. These ions, with the exception of those from the gaseous elements and those from the metallic elements occurring in the solvent necessary for epitaxy (Pb, B) are, for example, iron, arsenic and gallium ions. These ions are implanted in the garnet film at doses above those necessary for making the material amorphous.

Figure 1:
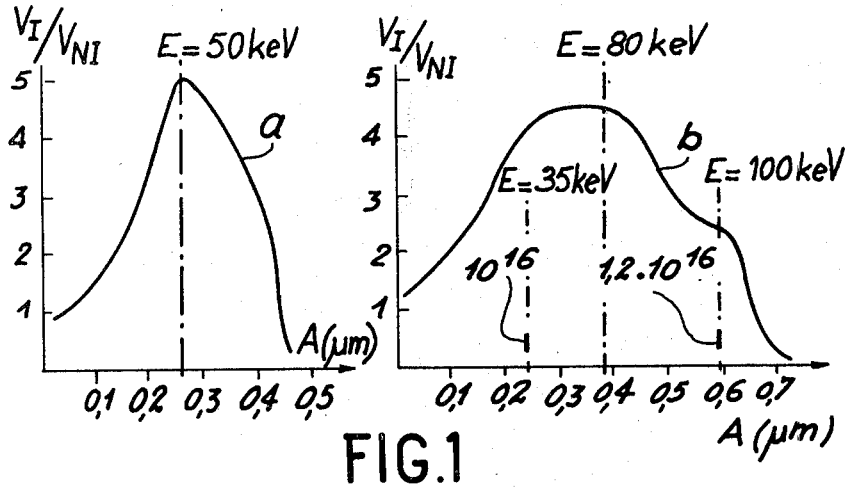
FIG. 1 already described, curves corresponding to a defect profile obtained during an implantation (curve a) and during several implantations (curve b) performed in a ferrimagnetic garnet film with hydrogen ions implanted at a dose of approximately $10^{16}$ atoms/cm$^2$ and at an energy of 50 keV.
Figure 2:
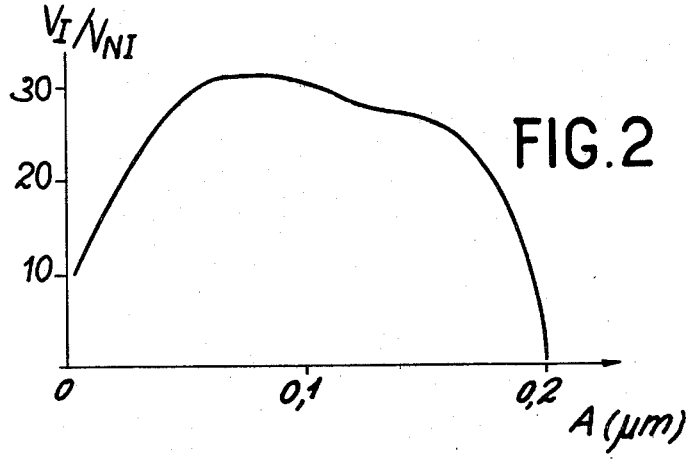
FIG. 2 a curve corresponding to a defect profile obtained during implantation performed in a ferrimagnetic garnet film with iron ions implanted at a dose of $10^{16}$ atoms/cm$^2$.

Such an ion implantation makes it possible to obtain a completely homogeneous or flat defect profile and consequently a homogeneous planar magnetization layer. This is illustrated in FIG. 2, which shows a curve corresponding to a defect profile obtained during an implantation, at a said dose of $10^{16}$ atoms/cm$^2$, of iron ions in a ferrimagnetic garnet film. It should be noted that an implantation of iron ions at a dose of $10^{16}$ atoms/cm$^2$ makes it possible to make the implanted layer amorphous, whereas an implantation of hydrogen ions at the same dose does not permit this.

On the basis of this curve, it can be seen that the homogeneous planar magnetization layer is close to 0.2 μm. This defect profile is obtained by differential etching measurements.

Moreover, it has been found that the etching rate of the material implanted according to the invention is much higher than in the case of materials implanted in accordance with the prior art. This shows that although the implanted layer according to the invention is completely amorphous, this was not the case for the materials implanted according to the prior art.

In order to rearrange the crystal lattice of the material (film and substrate) are recrystallize in monocrystalline form that part of the film previously made amorphous, said material undergoes annealing. According to the invention, annealing can be carried out by placing the material e.g. in an oxygen atmosphere, in an isothermal furnace in which there is a temperature between 400° and 1000° C.

It should be noted that the variations of the magnetic anisotropy field $H_k$ and the collapse field $H_c$ are functions of the annealing temperature of the implanted material. In view of the fact that the temperatures, during the subsequent technological stages, e.g. for producing deposits, spacings and passivation layers are between 300° and 400° C., the operating area of the implanted layer is for annealing processes above 400° C.

Figure 3:
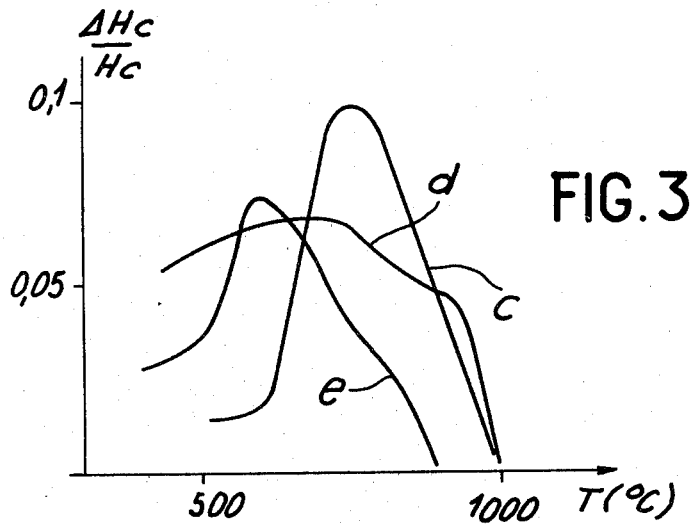
FIG. 3 curves illustrating the variations of the collapse field $H_c$ as a function of the annealing temperature (T) in degrees C., for an implantation of $10^{16}$ atoms/cm$^2$ in a ferrimagnetic garnet film and having an energy of 120 keV, curve c representing an implantation of iron ions, curve d an implantation of gallium ions and curve e an implantation of aresenic ions.

Various measurements of the physical characteristics were carried out on samples of materials implanted and annealed according to the invention. Firstly, the variation $\Delta H_c$ of the collapse field $H_c$ between the implanted layer and the non-implanted layer of the material were measured as a function of the annealing temperature. These measurements are illustrated by the curves of FIG. 3 giving the $\Delta H_c/H_c$ ratio, $H_c$ representing the collapse field of the untreated film, as a function of the annealing temperature (T), expressed in °C. Curve c corresponds to an implantation or iron ions at a dose of $10^{16}$ atoms/cm$^2$ and having an energy of 120 keV, curve d to an implantation of gallium ions at a dose of $10^{16}$ atoms/cm$^2$ and having an energy of 120 keV and curve e to an implantation of arsenic ions at a dose of $10^{16}$ atoms/cm$^2$ and having an energy of 120 keV.

On the basis of these curves, it can be seen that the maximum variation of the collapse field is obtained for annealing temperatures between 600° and 700° C. Moreover, it can be seen that this variation is greater when iron ions are implanted (curve c).

Figure 4:
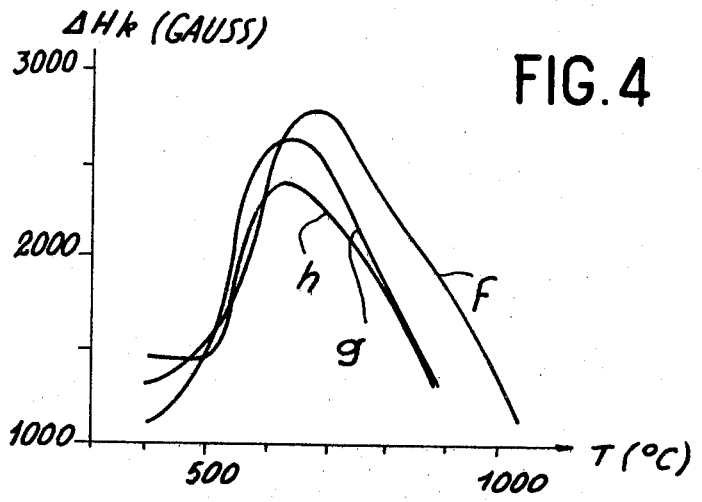
FIG. 4 curves illustrating variations of the anisotropy field $H_k$ as a function of the annealing temperature (T) expressed in °C., for an implantation of $10^{16}$ atoms/cm$^2$ in a ferrimagnetic garnet film and having an energy of 120 keV, curve f representing an implantation of iron ions, curve g an implantation of gallium ions and curve h an implantation of arsenic ions.

This was followed by a measurement of the variation $\Delta H_k$ of the magnetic anisotropy field as a function of the annealing temperature and then by ferromagnetic resonance measurements by applying a magnetic field perpendicular to the material sample, the resonant frequency being 9 GHz. These variations $\Delta H_k$ represent the different between the value of the anisotropy field of the ferrimagnetic layer which has undergone an implantation and the value of the anisotropy field of the ferrimagnetic layer which has not undergone implantation. These measurements are illustrated by the curves of FIG. 4 giving $\Delta H_k$, expressed in gauss, as a function of the annealing temperature in °C. For an implantation of $10^{16}$ atoms/cm$^2$ in a ferrimagnetic garnet film and having an energy of 120 keV, curve f represents an implantation of iron ions, curve g an implantation of gallium ions and curve h an implantation of arsenic ions.

On the basis of these curves, it can be seen that the maximum variation of the anisotropy field is obtained for annealing temperatures between 600° and 700° C. It is also clear that this variation is greatest when implanting iron ions (curve c).

On the basis of these different measurements, it can be deduced that the annealing temperature is preferably chosen between 600° and 700° C. and that the ions to be implanted are preferably iron ions.

This was followed by the measurement of the intensity of the magnetic signal i of the implanted layer. The intensity of signal i is governed by the equation:

$$i=(\Delta H_i/H_o)\ 2\ (h_i/h_o)$$

in which $\Delta H_i$ and $\Delta H_o$ respectively represent the width of the implanted ferromagnetic resonance mode and the major mode and in which $h_i$ and $h_o$ respectively represent the height of the implanted mode and of the major mode. This measurement was carried out on ferrimagnetic garnet samples implanted with iron ions at a dose of $3.10^{16}$ atoms/cm$^2$ and an implantation energy of 120 keV, followed by annealing respectively at temperatures of 500°, 650° and 700° C.

Figure 5:
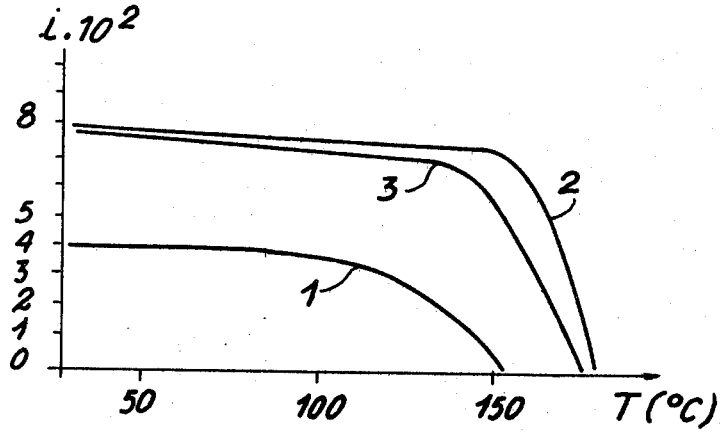
FIG. 5 curves giving the variations of the magnetic signal i as a function of the temperature (T) expressed in °C. of a ferrimagnetic garnet film implanted with iron ions at a dose of $3.10^{16}$ atoms/cm$^2$ and at an energy of 120 keV, followed by annealing, curve 1 corresponding to annealing at 500° C., curve 2 to annealing at 650° C. and curve 3 to annealing at 700° C.

This measurement is illustrated by the curves of FIG. 5 giving the variations of the intensity of signal i, to within a factor of $10^2$, as a function of the temperature expressed in °C. This measurement is linked with the number of resonant electronic spins in the implanted layer. Curve 1 corresponds to annealing at 500° C., curve 2 to annealing at 650° C. and curve 3 to annealing at 700° C.

This measurement demonstrates the quality of the implanted layer from the standpoint of the magnetic homogeneity thereof. These curves show an important area in which the signal i varies little or not at all with temperature. In particular, signal i given by annealing at 650° C. (curve 2) demonstrates the excellent quality and homogeneity of the implanted layer.

Figure 6:
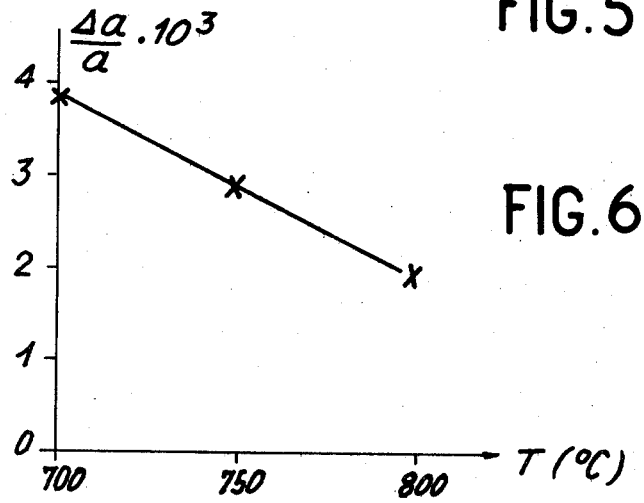
FIG. 6 a curve giving the ratio $\Delta a/a$ to within a factor of $10^3$, as a function of the annealing temperature (T), expressed in °C., for a ferrimagnetic garnet film implanted with iron ions at a dose of $10^{16}$ atoms/cm$^2$ and having an energy of 150 keV.

Using X-ray diffraction, ratio a/a was measured, which is governed by equation:

$$\Delta a/a=(a_o-a_i)/a_o$$

in which $a_o$ and $a_i$ respectively represent the parameter of the crystal mesh of the non-implanted film and the implanted film. This measurement was carried out on ferrimagnetic garnet samples implanted with iron ions at a dose of $10^{16}$ atoms/cm$^2$ and with an implantation energy of 150 keV, followed by annealing at temperatures between 700° and 800° C. The variations of the ratio Δa/a as a function of the annealing temperature, expressed in °C., are illustrated by the curve of FIG. 6.

This curve shows that the values obtained are very low, which demonstrates that the amorphized and then annealed material according to the invention has reacquired an excellent crystal structure, which seems to correspond to a re-epitaxy phenomenon of the implanted layer on the non-implanted layer during annealing.

Hitherto, only furnace annealing has been envisaged, but studies show that the annealing of materials implanted according to the invention can be carried out by a laser beam. In the same way as furnace annealing, laser beam annealing makes it possible to rearrange the crystal lattice of the material disturbed during implantation. Unlike furnace annealing, this annealing makes it possible to locally anneal the material through focusing the laser beam.

Moreover, only the use of a single implantation has been envisaged. However, a multiimplantation of ions can be considered. This can be carried out with one or more ions at the same or difference doses and at the same or different energy levels. Thus, with each monoimplantation of ions at a given energy and dose is associated a crystalline defect profile, an average penetration distance in the material, as well as a width at mid-height of the defect profile.

Multiiplantation can be carried out in order to obtain the greatest possible magnetic homogeneity in the implanted region through the addition of crystal defects profiles leading to a flat profile. This can be obtained with a multiimplantation of ions, particularly iron ions at different energies. This multiimplantation can also be carried out so as to oppose growth anisotropy over a large thickness, which can be brought about by the implantation of different ions at different energies.

It is also possible to envisage the obtaining of a double homogeneous planar magnetization layer, i.e. two planar magnetization layers on either side of the magnetic bubble so as to obtain a better stabilization of the latter. This can be brought about by a high energy implantation of light ions in the lower part of the garnet film and by an implantation of heavier ions and particularly iron ions in the upper part of the garnet film.

What is claimed is:

1. A process making it possible to obtain at least one homogeneous planar magnetization layer in a ferrimagnetic garnet film obtained by liquid phase epitaxy in a solvent on a monocrystalline amagnetic substrate, wherein in said film at least one implantation of ions takes place, with the exception of the ions of gaseous elements and with the exception of the ions of the metallic elements involved in the composition of the solvent, this taking place at a dose making it possible to render the implanted part of the garnet film amorphous, and wherein the film and the substrate are annealed in order to crystallize in monocrystalline form that part of the film rendered amorphous by implantation.

2. A process according to claim 1, wherein a multiimplantation of ions takes place in said film by carrying out a first implantation of a particular type of ions, followed by at least one second implantation of other types of ions, in order to obtain different properties at the same depth.

3. A process according to claim 1, wherein a multiimplantation of ions of different types is performed in the said film, each type of ions being implanted at a different depth in order to obtain different properties at different depths.

4. A process according to claim 3, wherein a double homogeneous planar magnetization layer is formed by carrying out a first ion implantation in the upper part of the film and a second ion implantation in the lower part of the film and this is carried out with ions which are lighter than the first ions, in order to obtain a better magnetic stabilization.

5. A process according to claim 1, wherein the implanted ions are ions of an element chosen from among iron, arsenic and gallium.

6. A process according to claim 5, wherein the chosen element is iron.

7. A process according to claim 1, wherein annealing is carried out in a furnace in which there is a temperature between 400° and 1000° C.

8. A process according to claim 7, wherein annealing is performed in an oxygen atmosphere.

9. A process according to claims 7 or 8, wherein the temperature is between 600° and 700° C.

10. A process according to claim 1, wherein annealing is performed by means of a laser beam.

* * * * *